US005153649A

United States Patent [19]

Park

[11] Patent Number: 5,153,649

[45] Date of Patent: Oct. 6, 1992

[54] DEVICE FOR MOUNTING A MAGNETIC ROLLER OF A DEVELOPING UNIT FOR A COPYING APPARATUS

[75] Inventor: Chan S. Park, Seoul, Rep. of Korea

[73] Assignee: Gold Star Co., Ltd., Seoul, Rep. of Korea

[21] Appl. No.: 780,511

[22] Filed: Oct. 22, 1991

[30] Foreign Application Priority Data

Oct. 23, 1990 [KR] Rep. of Korea ..... 16108/1990

[51] Int. Cl.[5] ..... G03G 15/06

[52] U.S. Cl. ..... 355/260; 355/215; 355/245

[58] Field of Search ..... 355/245, 251, 259, 215, 355/260; 118/657, 658

[56] References Cited

U.S. PATENT DOCUMENTS 4,373,468 2/1983 Suda et al. ..... 118/658
4,410,260 10/1983 Kuehnle ..... 355/259 X
4,922,302 5/1990 Hill et al. ..... 355/251
5,036,358 7/1991 Yoshida ..... 355/245 X

FOREIGN PATENT DOCUMENTS 2-103067 4/1990 Japan .

*Primary Examiner*—Joan H. Pendegrass
*Assistant Examiner*—Nestor R. Ramirez
*Attorney, Agent, or Firm*—Finnegan, Henderson, Farabow, Garrett and Dunner

[57] ABSTRACT

A device for mounting a magnetic roller which is disposed in a developing unit of a copying apparatus to apply toner to a drum at a given thickness. The device includes a toner box composed of two separate boxes which are joined to each other by an adhesive tape, and coil springs extending between the boxes. The second box is provided with protruding guide portions for receiving and supporting the magnetic roller therein to prevent an overflow of toner from the toner box.

7 Claims, 3 Drawing Sheets

DEVICE FOR MOUNTING A MAGNETIC ROLLER OF A DEVELOPING UNIT FOR A COPYING APPARATUS

BACKGROUND OF THE INVENTION

1. Field of the Invention

This invention relates to a device for mounting a magnetic roller which is disposed in a developing unit of a copying apparatus, such as a copying machine or a laser beam printer, and more particularly, to a device for mounting the magnetic roller to prevent an overflow of toner while constantly maintaining a given distance between the magnetic roller and a drum.

2. Discussion of the Related Art

A copying apparatus, such as a copying machine or a laser beam printer, is shown in FIG. 1 of the accompanying drawings. The copying apparatus of FIG. 1 comprises a charging unit 2 for applying an electric charge to a peripheral surface of a drum 1, a developing unit 4 for applying toner to an electric latent image formed on the drum 1 by a light incident on the drum 1 through a lens portion 3, a transfer unit 5 for transferring and attaching the applied toner to a copying paper, and a toner recovery unit 6 for recovering toner waste attached to the drum 1. The units are disposed around the drum 1. In the copying apparatus of FIG. 1, printing is accomplished by feeding a paper 8 from a paper feed tray 7 which passes between the drum 1 and the transfer unit 5, and then through a fixing unit 9.

With this construction, the developing unit 4 plays an especially important role of feeding the toner in the form of fine powder to the drum 1 to apply the toner on the latent image on the drum 1 at a constant thickness. In order to uniformly apply the toner, which is stored in a toner box of the developing unit 4, on the drum, a magnetic roller is provided inside the toner box with a magnet and maintained at a given distance from the surface of the drum to set the thickness of a toner coating.

In the past, as shown in FIGS. 2 and 3 of the accompanying drawings, the magnetic roller 11 has been disposed in the toner box 15 through a pair of opposite swing arm brackets 10. Each of the brackets 10 is coupled at one end to a shaft of the magnetic roller 11 and fixedly secured at the other end to a hinge rod 12 which is disposed parallel to the magnetic roller 11 and pivotally supported on the opposite sidewalls of the toner box 15. Collars 14, each having a diameter larger than that of the magnetic roller 11, are secured to the shaft of the magnetic roller 11 at respective outer surfaces of the swing arm brackets 10. Springs 13 are each disposed about the hinge rod 12 between the outer surface of each bracket 10 and the inner surface of each sidewall of the toner box 15.

With this arrangement, the swing arm brackets 10 are normally urged, under the resiliency of the springs 13, to rotate about the hinge rod 12 in a counterclockwise direction (as viewed in the drawings), so that the collars 14 are kept in direct contact with the drum 1. Due to a difference in diameter between the collar 14 and the magnetic roller 11 (the collar being larger than the magnetic roller), a spacing between the drum 1 and the magnetic roller 11 is defined.

The conventional device as mentioned above may constantly maintain the given distance between the drum 1 and the magnetic roller 11 without any difficulty. However, since the swing arm brackets 10 disposed in the toner box 15 must be mounted spaced apart from the toner box for their operation, the device encounters a problem in which the toner may overflow through the spacing.

Therefore, the conventional device is disadvantageous, in that, since the freely movable mounting of the swing arm brackets 10 in the toner box 15 requires a spacing between the brackets and the toner box, the toner may flow out of the toner box through the spacing. When the toner flows out of the toner box, the machine becomes polluted and the performance is reduced.

SUMMARY OF THE INVENTION

The present invention has been made in view of the above circumstances and it is an object of the present invention to improve a magnetic roller mounting structure to prevent an overflow of toner from a toner box.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the above objects and in accordance with the purpose of the present invention, a device for mounting a magnetic roller of a developing unit for a copying apparatus is provided. The device comprises a toner box having a first box for storing toner and a second box connected to the first box by an adhesive tape of an elastic material, the second box having protruding guide portions formed on opposite sides of a front opening thereof to receive and support the magnetic roller therein, and coil springs extending between the first and second boxes for exerting a biasing force. Collars are secured to the opposite ends of the magnetic roller mounted in the second box to maintain a given distance between a drum and the magnetic roller.

BRIEF DESCRIPTION OF THE DRAWINGS

The invention will be more fully understood from the following detailed description thereof, taken in connection with the accompanying drawings, in which.

DESCRIPTION OF THE PREFERRED EMBODIMENT

Figure 1:
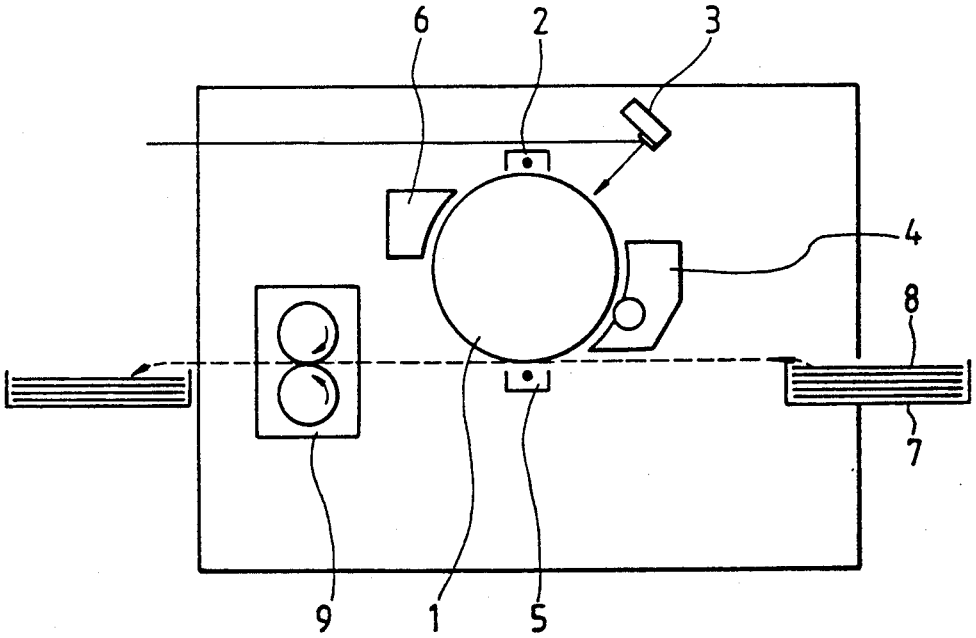
FIG. 1 is a schematic view of an entire construction of a copying apparatus.
Figure 2:
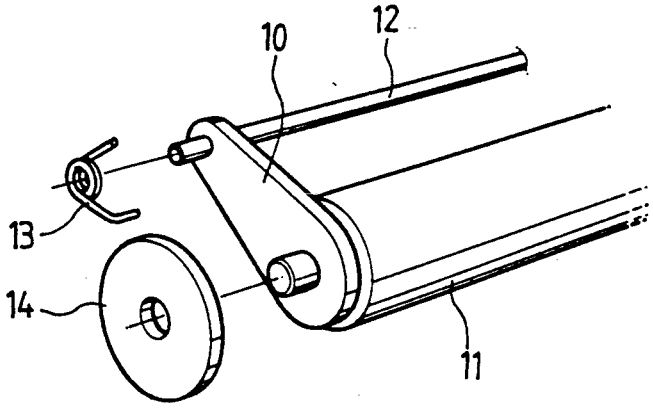
FIG. 2 PRIOR ART
FIG. 2 is a fragmentary perspective view of a magnetic roller mounting device according to the prior art.
Figure 3:
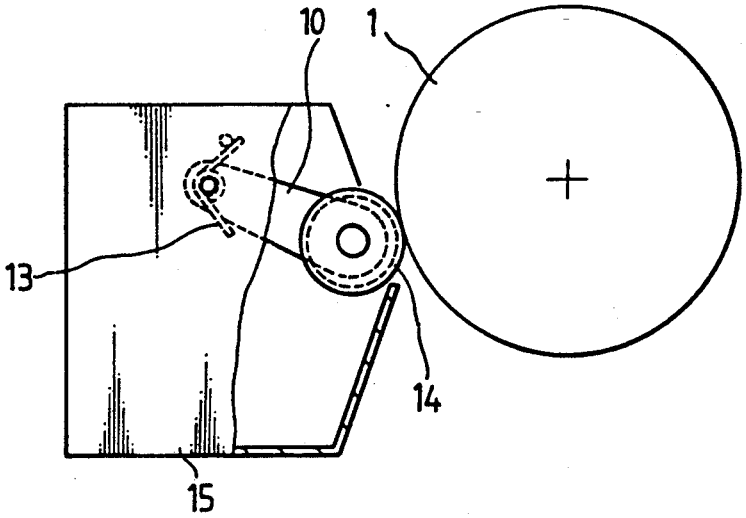
FIG. 3 PRIOR ART
FIG. 3 is a cross-sectional view of a magnetic roller mounting device according to the prior art.

The apparatus of the present invention will be described in detail referring to the illustrations in the accompanying drawings, in which like reference characters designate like or corresponding parts throughout the drawings.

Figure 4:
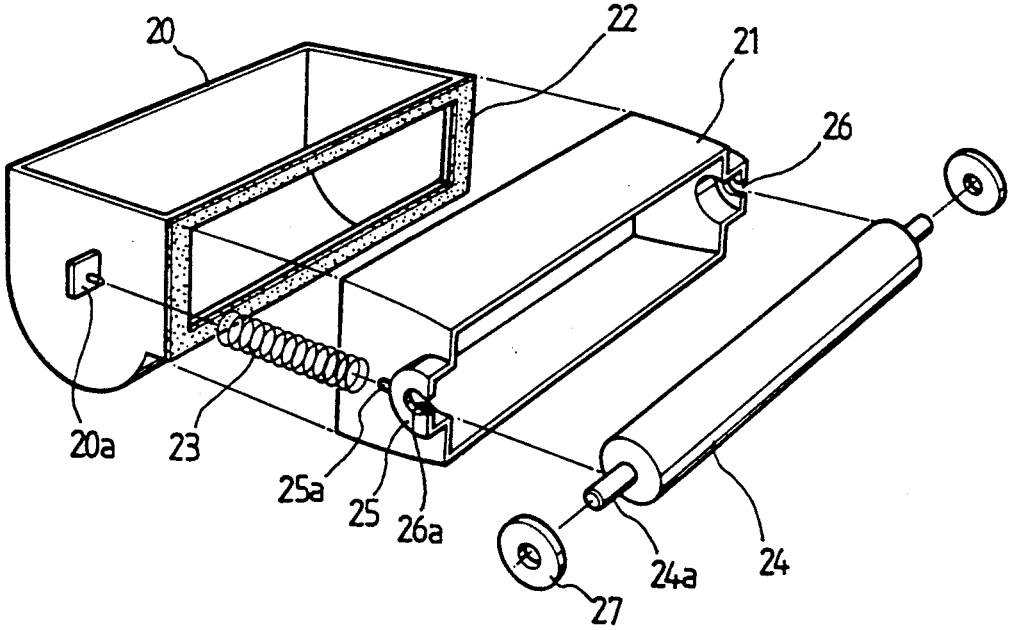
FIG. 4 is an enlarged perspective view of a magnetic roller mounting device according to the present invention.

Referring to FIG. 4 which illustrates an enlarged perspective view of a device according to the present invention, a toner box for storing toner is shown including a first box 20 and a second box 21 separate from the first box 20. The first box 20 and the second box 21 are bonded to each other by adhesive means, such as an adhesive tape. Preferably, an elastic, double-sided adhesive tape 22 is used to bond the first box 20 and the second box 21 together.

The purpose of having the toner box formed of two separate boxes which are joined by the elastic, double-sided tape 22 is to reduce the floating of a magnetic roller 24 disposed in the leading end of the second box 21.

Biasing means, such as coil springs 23, are disposed between the first and second boxes 20 and 21, respectively, as will be described later in more detail, so that the magnetic roller 24 in the second box 21 is normally biased in the forward direction under the resiliency of the coil springs 23.

Figure 5:
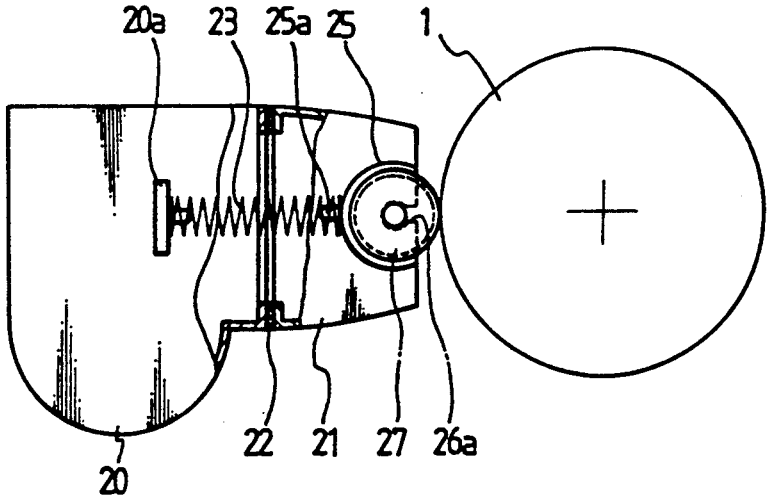
FIG. 5 is a cross-sectional view of the device of the present invention in an assembled state.

The magnetic roller 24, as shown in FIG. 5, serves to apply the toner to a drum 1 while being constantly positioned at a given distance from the peripheral surface of the drum 1. As shown in FIG. 4, the magnetic roller 24 is disposed at the front portion of the second box 21 with the opposite end portions thereof partially enclosed by guide portions 25. The guide portions 25 are formed protruding outwardly from opposite sides of the second box 21 in conformity with the length of the magnetic roller 24. Guide shafts 24*a* on each end portion of the magnetic roller 24 are inserted into respective shaft receiving grooves 26 formed in the protruding guide portions 25. Each shaft receiving groove 26 has engaging jaws 26*a* and a diameter slightly larger than that of the guide shaft 24*a* to allow the magnetic roller 24 to rotate smoothly. The spacing between the engaging jaws 26*a* is defined to be slightly smaller than the diameter of the guide shaft 24*a* such that the shaft 24*a*, when inserted into the groove 26, does not come out easily.

Collars 27, which are shown in FIG. 5 to have a diameter larger than the diameter of the magnetic roller 24, are secured to the respective ends of the guide shaft 24*a* of the magnetic roller 24, so that as the collars 27 come into contact with the drum 1, a given distance is defined between the drum 1 and the magnetic roller 24. The collars 27 are normally biased into close contact with the drum 1 under the resiliency of the coil springs 23. Each of the coil springs 23 extends between respective protruding pieces 20*a* formed projectingly from the opposite sidewalls of the first box 20 and respective projection bars 25*a* formed on the rear of the guide portions 25 of the second box 21. Further, the floating of the magnetic roller 24, which may be generated by the operating drum 1, is counteracted by the double-sided tape 22 of a given thickness attached between the abutting surfaces of the first and second boxes 20 and 21 to maintain a constant distance between the magnetic roller 24 and the drum 1.

In addition, since the collars 27, which come into contact with the drum 1, project outwardly from the sidewalls of the second box 21, and the magnetic roller 24 is mounted in the second box 21 with the opposite end portions thereof enclosed by the guide portions 25 substantially free from a spacing therebetween, the overflow of toner from the toner box is prevented.

As described above, the device for mounting a magnetic roller of a developing unit for a copying apparatus according to the present invention has the following advantages. The magnetic roller is mounted to allow smooth rotation in the toner box formed of two separate boxes which are joined by a double-sided adhesive tape for counteracting the floating of the magnetic roller, with coil springs extending between the two boxes to impart a biasing force to the magnetic roller. A given distance is formed between the drum and the magnetic roller which is kept constant. An overflow of toner from the toner box is prevented, therefore, ensuring a long service life of the machine, as well as enhancing the performance of the machine.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A device for mounting a magnetic roller of a developing unit for a copying apparatus, comprising:

a first box for storing toner, said first box having sidewalls;

a second box having a front opening and protruding guide portions disposed on opposite sides of said front opening to receive and support said magnetic roller within said second box;

adhesive means for joining said first and second boxes; and biasing means disposed between said first and second boxes to exert a biasing force on said magnetic roller.

2. A device for mounting a magnetic roller of a developing unit for a copying apparatus according to claim 1, wherein said biasing means comprises coil springs.

3. A device for mounting a magnetic roller of a developing unit for a copying apparatus according to claim 1, wherein said adhesive means comprises a double-sided adhesive tape of an elastic material.

4. A device for mounting a magnetic roller of a developing unit for a copying apparatus according to claim 1, wherein each of said protruding guide portions of said second box is provided with a shaft receiving groove having at least one engaging jaw.

5. A device for mounting a magnetic roller of a developing unit for a copying apparatus according to claim 1, wherein said magnetic roller has a guide shaft at each end portion and each of said guide shafts is inserted into respective ones of said protruding guide portions.

6. A device for mounting a magnetic roller of a developing unit for a copying apparatus according to claim 5, wherein each of said sidewalls of said first box has a protruding piece and each of said protruding guide portions of said second box has a projection bar formed on a rear side of each of said protruding guide portions.

7. A device for mounting a magnetic roller of a developing unit for a copying apparatus according to claim 6, wherein said biasing means extends between said each protruding piece and said each projection bar, respectively.

* * * * *